US006318604B1

(12) United States Patent
Messner

(10) Patent No.: US 6,318,604 B1
(45) **Date of Patent: *Nov. 20, 2001**

(54) SPILL INHIBITING SPOUT

(75) Inventor: Marvin Messner, Stanberry, MO (US)

(73) Assignee: No-Spill Research, Inc., Stanberry, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/673,483

(22) PCT Filed: Apr. 7, 1999

(86) PCT No.: PCT/US99/07346

§ 371 Date: Oct. 6, 2000

§ 102(e) Date: Oct. 6, 2000

(87) PCT Pub. No.: WO99/51518

PCT Pub. Date: Oct. 14, 1999

(51) Int. Cl.[7] ..... B67D 3/00

(52) U.S. Cl. ..... 222/478; 222/481.5; 222/488; 222/529

(58) Field of Search ..... 222/478, 481.5, 222/488, 529, 1

(56) References Cited

U.S. PATENT DOCUMENTS

| | | | |
|---|---|---|---|
| 2,197,352 | 4/1940 | Terkel | 221/28 |
| 3,913,611 | 10/1975 | St. John | 137/453 |
| 4,722,463 | 2/1988 | Anderson | 222/185 |
| 4,746,036 | 5/1988 | Messner | 222/484 |
| 4,834,270 | 5/1989 | Messner | 222/484 |
| 5,042,698 | 8/1991 | Fessell | 222/481.5 |
| 5,988,458 | 11/1999 | Messner | 222/478 |

*Primary Examiner*—Kevin Shaver
*Assistant Examiner*—Frederick Nicolas
(74) *Attorney, Agent, or Firm*—Hovey, Williams, Timmons & Collins

(57) ABSTRACT

A spout (10) for mounting on a liquid container (12) to provide controlled dispensing of liquid therefrom includes a manual control for stopping the flow of liquid through a pouring tube (22) and an automatic control to prevent spills due to overfilling. Manual control over the amount of liquid flowing through the pouring opening of the spout (10) is provided by a preferably tubular rod (26) having a stop (28) mounted at one end and a push button actuator (34) at the other end of the rod (26). The spout (10) includes a body (24) with the pouring tube (22) extending from one side and the push button (34) for opening the stop (28) to dispense liquid on the other side of the body. The automatic control is provided through a vent tube (30) which extends through a port in the pouring tube (22) and is connected to the tubular rod (26) which is provided with at least one hole. When the level of liquid in a receiving tank rises over the port, no air enters the liquid container (12) and consequently the flow of liquid from the pouring tube (22) is discontinued.

20 Claims, 2 Drawing Sheets

SPILL INHIBITING SPOUT

BACKGROUND OF THE INVENTION

1. Field of the Invention

This invention concerns a spout for use with a liquid container to provide a liquid dispenser, such as a gasoline jug, and which inhibits spillage of liquid due to overflow of the liquid during filing of a receiving tank. More particularly, it concerns a spout which may be readily attached to a liquid container and is manually controllable as well as automatically inhibiting overflow by cutting off the inflow of air once the receiving tank is filled.

2. Description of the Prior Art

While conventional pour spouts are available and in use by consumers for dispensing petroleum products such as oil and kerosene into gasoline tanks of lawn mowers and similar equipment, increasing attention is being focused on the use of spouts which inhibit spillage. Areas with air pollution problems are looking for ways to reduce to release of volatile organic compounds (VOCs) into the atmosphere. When a container, such as a gasoline jug, is used to pour gasoline into the fuel tank of an engine, it is common for the user to overfill the tank. The spilled fuel represents not only a fire hazard and may damage plant life, but also represents an undesired source for the release of organic vapors which pollute the atmosphere.

One partial solution is shown in my previous U.S. Pat. Nos. 4,746,036 and 4,834,270. These patents show an example of the use of a remotely operated spout where the operator can virtually instantaneously stop the flow of liquid from a tank. This same concept is shown in the separate spout shown in the drawings and labeled "prior art". This spout is currently offered on a fuel jug sold by No-Spill Research, Inc. of Stanbury, Mo., and features a push-button operated closure with a detachable extension on the spout. The spout permits the user to simply release the button and stop the flow of fuel. However, in the event the user inadvertently keeps the button depressed after the receiving tank is filled, air can continue to flow into the fuel jug adjacent the button, and fuel thereby continues to flow into the tank.

Other attempts to solve this problem have resulted in spouts which are difficult to operate. In one case, a spout is actuated by shifting a spring-loaded exterior sleeve engageable with the rim of the receiving tank relative to the remainder of the spout and the fuel jug. The force required to overcome the spring is cumbersome and difficult to control, and the application of force may cause the receiving tank or jug to tip and spill the contents. In addition, a preferred spout will resist the escape of vapors during periods of storage. There has thus arisen the need for a simple and effective pouring spout which inhibits spillage, both by limiting the entry of air once the receiving tank is filled and also by providing a manual control to shut off the flow of liquid.

SUMMARY OF THE INVENTION

These and other objects have largely been met by the spill inhibiting spout of the present invention. That is to say, the spout hereof provides both a manual control and a vent control to inhibit undesired overflow of the dispensed liquid from a receiver. The manual control is advantageously spring biased to the closed position and permits one handed operation by the user without the need for shifting the entire spout. The vent control effectively shuts off the flow of air into the spout when the level of liquid in the receiver rises to cover the air intake port. When the spout is fixed in sealing relationship with the container to which it is mounted, the inability to introduce air into the container to replace the volume of the dispensed liquid causes a partial vacuum therein. This in turn slows or stops the flow of liquid out of the spout.

The spout air intake is located on a sidewall of the pouring tube and directs a return flow of air into the container when the manual button is depressed and liquid flows from the spout. Advantageously, the intake port communicates the air into the container through a vent tube and then to a tubular rod which also actuates the stop. The holes which allow the air to move from the rod into the container are located inside the body of the spout only when the discharge button is depressed. This largely prevents dangerous and undesirable venting of fumes when the stop is in the closed position, as there is no outlet for the passage of fumes to the atmosphere. The tubular rod mounts the stop and a conduit at one end and spring and the button adjacent the ports on the other end. The stop is preferably frustoconical in configuration to promote laminar flow of the liquid and provide good sealing engagement with an internal annular seat or rim within the pouring tube.

The spout hereof can be used with virtually any liquid, can be sized for mounting on containers of various sizes and is easily controlled. The operation of the pouring spout is greatly simplified in comparison to other vent limiting spouts, in that the user can simply tip the dispenser, i.e. the container and spout, so that the pouring tube and its air intake port are located in the receiving tank. By depressing the button positioned opposite the pouring tube, liquid is dispensed past the stop, and releasing the button causes corresponding cessation of liquid flow. If the button is retained in a depressed position until the liquid level in the tank rises to a level covering the air intake port on the pouring tube, a partial vacuum is formed within the dispensing container and liquid slows and then stops flowing from the pouring tube.

These and other advantages will be readily apparent to those skilled in the art with reference to the following drawings and description of the preferred embodiment shown therein.

DESCRIPTION OF THE PREFERRED EMBODIMENT

Figure 7:
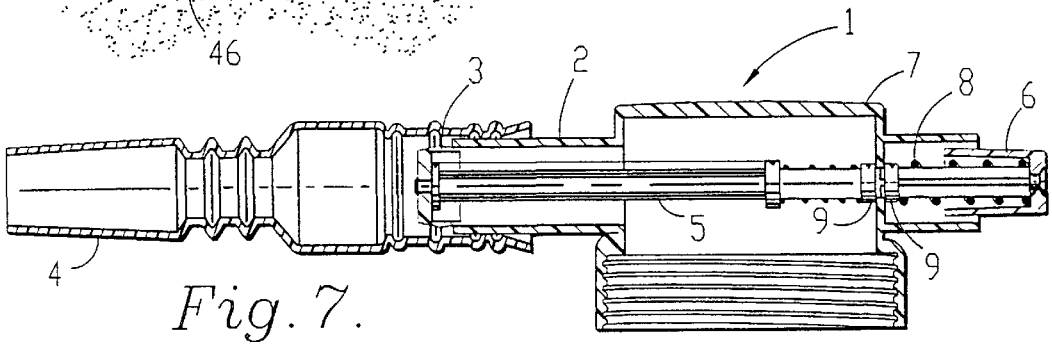
Fig. 7. (Prior Art)
FIG. 7 is a vertical cross-sectional view similar to FIG. 5 of a prior art spout.
Figure 2:
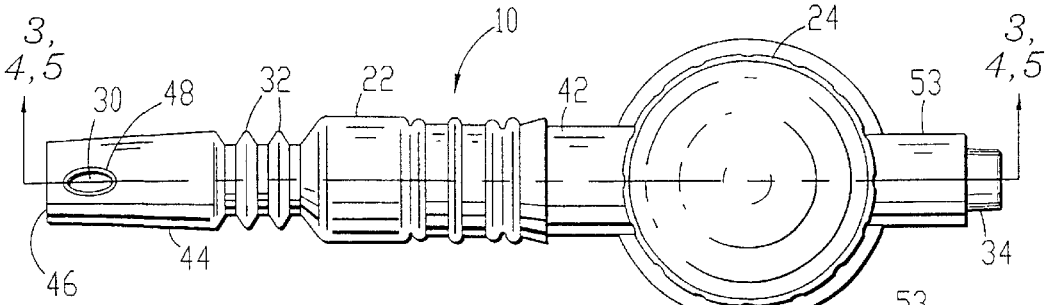
FIG. 2 is a top plan view of the spout.
Figure 3:
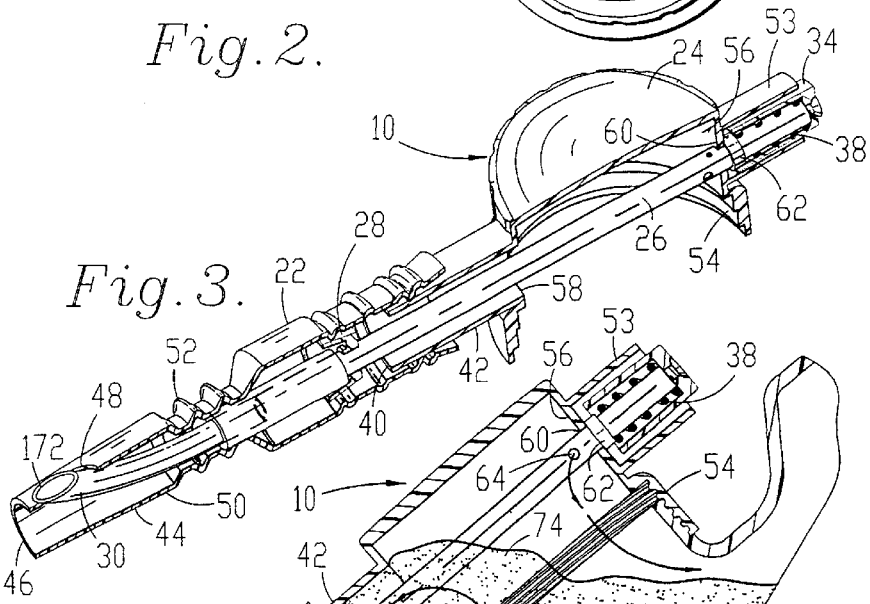
FIG. 3 is a vertical sectional view in perspective along line 3—3 of FIG. 2, showing the flow release button in a depressed or actuated position.

Referring now to the drawings, FIG. 7 illustrates a prior art spout 1 adapted for coupling to a liquid container by threaded attachment, chemical bonding or heat sealing. The spout 1 as shown includes a pouring tube 2 with a stop 3 for preventing liquid flow. An extension 4 is frictionally fitted over the pouring tube 2. The stop 3 is carried by a solid shiftable rod 5 connected to a button 6 and carried by a body 7. Spring 8 biases the button 6 and therefore the rod 5 and stop 3 to a closed position. By pressing on the button 6, the rod 5 shifts within the pouring tube 2 so that the stop is shifted away from its flow inhibiting position illustrated. Air enters the spout 1 between the body 7 and the rod 5 to replace the volume within the container vacated by the dispensed liquid. Seals 9 surround the rod 5 and are held in position by a seal spring to inhibit the escape of fumes from the spout 1 when the stop 3 is in the closed position, but no provision is made for limiting intake of air from either the pouring tube 2 or the extension 3 when liquid is being dispensed therefrom.

Figure 1:
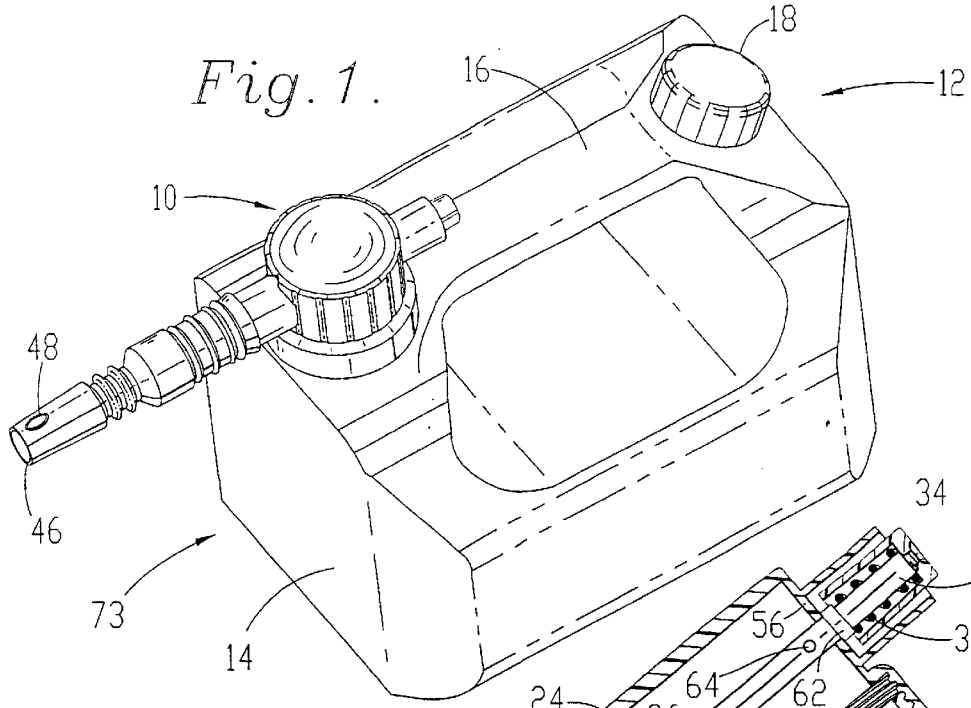
FIG. 1 is a top right front perspective view showing the spill-inhibiting spout hereof mounted on a liquid container.
Figure 6:
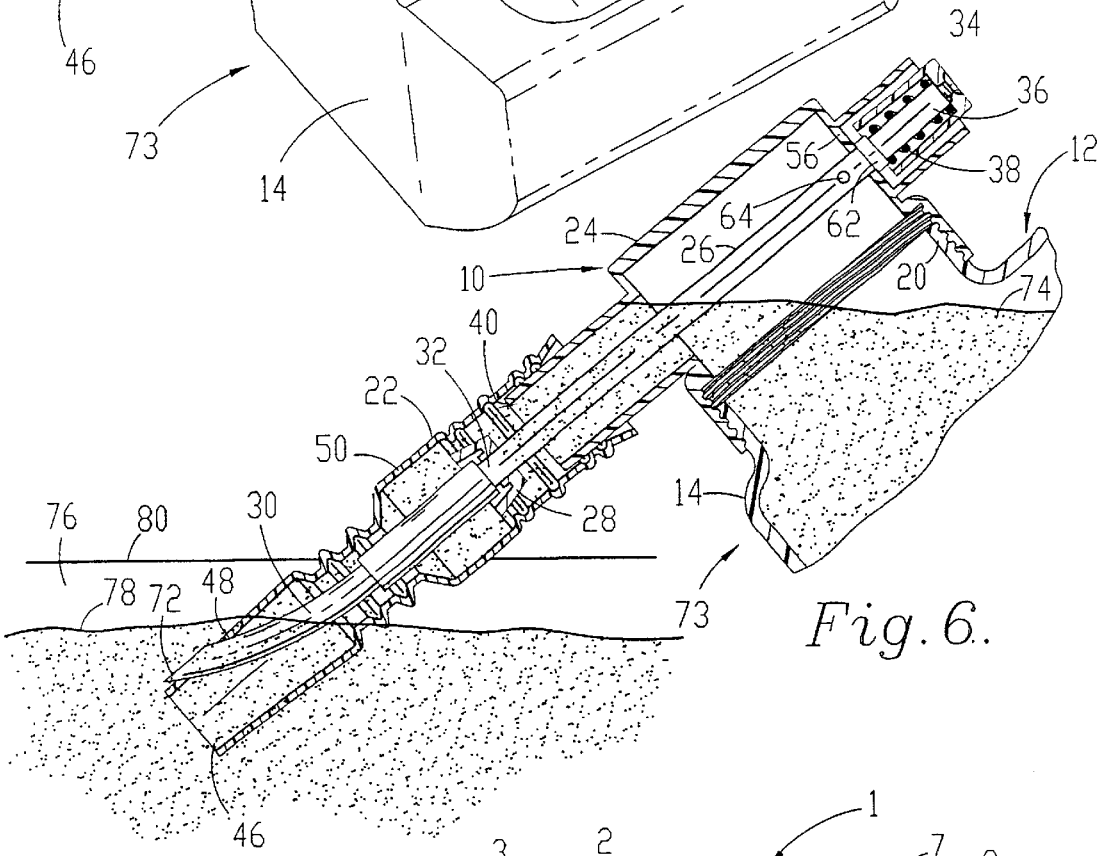
FIG. 6 is a fragmentary vertical cross-sectional view similar to FIG. 4, showing the pouring tube inserted beneath the liquid level of a receiving tank so that the spout air intake is beneath the surface, thereby inhibiting the further discharge of liquid from the spout.
Figure 4:
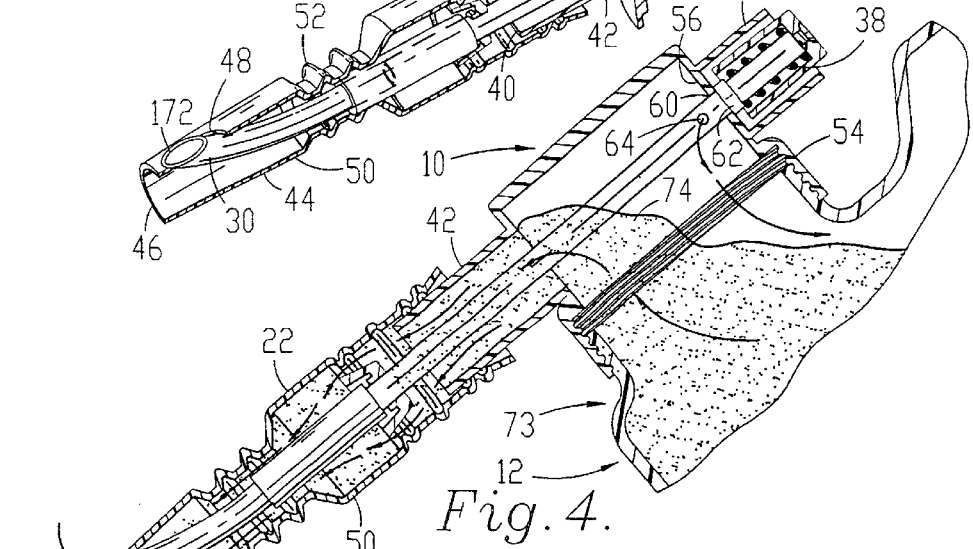
FIG. 4 is a fragmentary vertical cross-sectional view along line 4—4 of FIG. 2, showing the spout hereof mounted on a liquid container with arrows illustrating the liquid flow and return ventilation of gas into the container with the tubular rod shifting the stop to a first flow permitting position.

FIGS. 1 through 6 illustrate my new spill-inhibiting spout 10 in accordance with the present invention. As shown in FIG. 1, the spout 10 hereof is designed to be mounted on a liquid container 12 presenting a hollow reservoir 14, a graspable handle 16, and a filler cap 18 threadably mounted on the handle 16 to permit filling of the reservoir 14 without the need to remove the spout 10. The container 12 may be of metal, polyethylene or other suitably strong and leak-resistant material. The spout 10 may be screwed on to a threaded neck 20, as shown in FIGS. 4 and 6, or alternatively chemically bonded or heat welded onto a smooth neck to ensure proper alignment of the spout 10 relative to the container 12.

As shown in FIGS. 2 through 6, spout 10 broadly includes a pouring tube 22, a body 24, a tubular rod 26 mounting an annular stop 28 and a vent intake tube 30 at one end 32 and carrying a button 34 at the other end 36. A spring 38 is positioned between the body 24 and the button 34, thereby biasing the rod 26 toward the button 34 and the stop 28 into seating engagement with a seat 40 on the pouring tube 22.

In greater detail, pouring tube 22 may be provided as a single tubular extension from body 24, or as shown in the embodiment illustrated in the drawings, as a pipe 42 integrally formed with and extending from body 24 and a detachable, flexible extension 44 frictionally fitted over the pipe 42. The pouring tube 22 includes a pouring opening 46 at the remote end thereof, and a port 48 defined in sidewall 50 of pouring tube 22. The pouring tube 22 is preferably, though not necessarily, provided with corrugations 52 upstream from port 48 to provide flexibility for the pouring tube 22 and thereby permit the orientation of the pouring opening 46 to be changed. The annular seat 40 is preferably integrally formed with pouring tube 22 as a raised ridge to sealingly engage the stop 28 when seated thereagainst.

Figure 5:
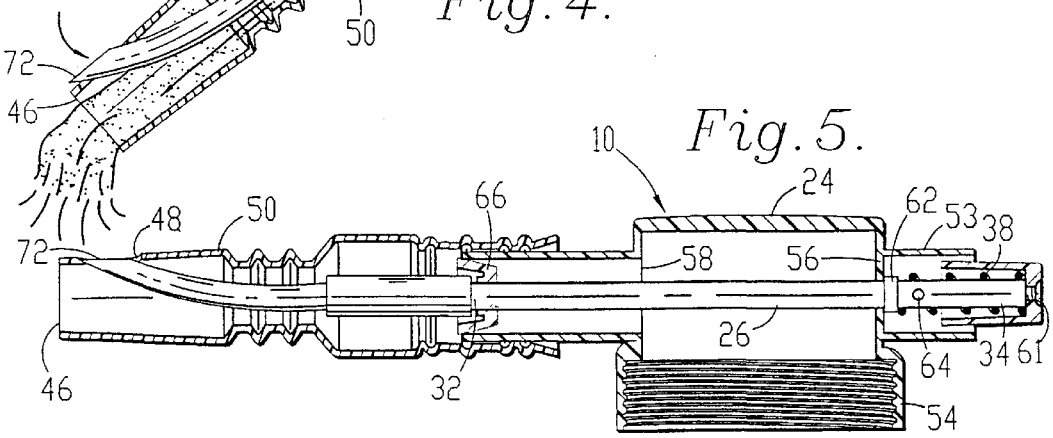
FIG. 5 is a vertical cross-sectional view of the spout taken along line 5—5 of FIG. 2, showing the flow release button in the extended position to shift the rod and the stop carried thereby to a second position inhibiting the flow of liquid through the pouring spout and past the stop.

Body 24 is substantially cylindrical about an upright axis, carrying pouring tube 22 and a button receiver 53 in opposed relationship located along a common normally horizontal axis as illustrated in FIG. 5. The body 24 includes an internally threaded collar 54 configured for mounting on neck 20, or alternatively the collar may be smooth for chemical bonding or welding to the neck or lugged for bayonet mounting, or other mounting relationship to permit the spout 10 to be attached to the neck 20 to avoid liquid leakage. The body 24 also includes a circular wall 56 presenting an opening 58 into pouring tube 22 and an opposed access 60 for the passage of tubular rod 26 therethrough. The access 60 is sized just large enough to accommodate rod 26 therethrough and thus not only acts a bushing supporting the rod 26 during shifting of the latter, but also as a seal to inhibit the undesired escape of liquid or vapors between the rod 26 and the body 24.

Tubular rod 26 is shiftably carried by the body 24 for reciprocating movement initiated by button 34 mounted to rod 26 by snap fitting, threads, or, as shown in the drawings, a set screw 61. The rod 26 presents one end 32 and other end 36 which is internally threaded to receive set screw 60. An O-ring 62 is mounted on tubular rod 26 and is located between button 34 and opening 58, the O-ring being biased in sealing relationship against access 60 by spring 38. Tubular rod 26 also presents at least one and preferably a plurality of holes 64 which are located on the exterior of the wall 56 when the button 34 is free and the stop 28 is resting against seat 40 as shown in FIG. 5, but which are located on the interior of the wall 56 when the button 34 is depressed and the stop 28 is unseated as shown in FIGS. 4 and 6.

The holes 64 fluidically communicate through a tubular channel within and extending the length of tubular rod 26 to vent intake tube 30 mounted on the one end 32 into the interior of the body 24 and thus fluidically communicate with the hollow interior of the liquid container 12. Stop 28 is also mounted on tubular rod 26 at one end 32. The stop 28 is preferably fixed by threading onto rod 26, adhesive, or other means whereby the stop is prevented from shifting along the rod 26. The stop 28 also preferably presents a frustoconical outer surface 66 to preferably cause the flow of liquid therepast to be more laminar and also to facilitate seating of the stop 28. The stop 28 may be of low-density polyethylene or a resilient, petroleum resistant synthetic resin material such as neoprene to further promote sealing. The tubular rod 26 extends forwardly from stop 28 into pouring tube 22 to receive a sleeve 68 of intake tube 30 thereon. Intake tube 30 also includes a curved portion 70 which is preferably of a flexible tubular synthetic resin material and provided with a diagonally cut end 72 to lie flush with the exterior of the pouring tube 22 and within port 48. The flexibility of the curved portion 68 facilitates shifting of the tubular rod 26.

The spout 10 hereof is useful in dispensing a variety of liquids, but its features are particularly beneficial in connection with dispensing gasoline, kerosene or other petroleum products because the design inhibits undesired escape of vapors of VOCs. In typical operation, the spout 10 is mounted to container 12 to provide a liquid dispenser 73. The user grasps handle 16 and tilts the container 12 so that the level of the liquid 74 within the container 12 flows through the opening 58 and into the pouring tube 22. When the user is ready to dispense the liquid 74, he pushes against the button 34 with a thumb or finger, thereby shifting the tubular rod and stop 28. This both permits liquid 74 to pass from pouring tube 22 and exposes the holes 62 within the circular wall of the body 24 so that as the liquid passes from the spout 10 through the pouring opening 46, air is permitted to enter through the vent intake tube 30 and through the holes 64 into the interior of the spout 10 and into the container 12 on which the spout 10 is mounted. At any time, the flow of liquid will cease when the user releases the button and the spring 38 returns the button 34 and tubular rod 26 to their initial position shown in FIG. 5, all the while maintaining O-ring 62 in sealing engagement over the access 60 and against the circular wall 56. The rearward shifting of the rod 26 also causes the stop 28 to seal against seat 40 to immediately cut off the flow of liquid past the stop 28.

In the event the user is dispensing the liquid 74 into a tank 76 or other receptacle, the level 78 of the liquid received therein may eventually rise to threaten spillage by overflow. The spout 10 hereof, when properly used, resists this eventuality. When the end 72 of the vent intake tube 30 below the rim 80 of the tank 76, the level 78 of the liquid 74 will rise above the end 72 before the liquid spills over the rim 80 and out of the tank. When the level 78 rises above the end 72 of the vent intake tube projecting through port 48, air is no longer able to enter into the spout 10 nor into the container 12 when the filler cap 18 is securely in place as shown in FIG. 1. A vacuum begins to build within the container, slowing the discharge of liquid through the pouring tube 22 until the flow therethrough virtually stops as shown in FIG. 6. Because the holes 64 are within the interior of the spout 10, no air may enter the container 12. The vacuum thus created is maintained, so that even if the user inadvertently keeps the button 34 open longer than desirable, spillage will be averted provided the end 72 remains beneath the level 78. Upon recognizing that the level 78 is at the maximum desired, the user will then know to release the button 34 to close the stop against its seat prior to lifting the end 72 above the level 78. During storage, vapors are prevented from escaping past the O-ring and the stop 34, and air may pass through the vent tube 30 without entering the interior of the container 12, thereby avoiding undesired escape of volatile fumes.

The construction of the spout 10 hereof thus permits one handed operation and a minimum of parts which can be readily assembled with a small expense, and is easy to use, maintain and store.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention. For example the use of a threaded collar on the spout 10 avoids the necessity for a separate filler cap 18, making the spout 10 hereof useful in connection with bleach bottles or other chemical containers where the liquids, if spilled, may be harmful. A lever or other engagement member could be substituted for the button 34 to shift the rod 26 from a position exterior to the body. Other examples of such modifications include making the tubular rod 26 of brass, synthetic resin or other crush-resistant material and integrally forming the rod 26 with vent tube 30.

The inventor hereby states his intent to rely on the Doctrine of Equivalents to determine and assess the reasonably fair scope of his/their invention as pertains to any apparatus not materially departing from but outside the literal scope of the invention as set out in the following claims.

What is claimed is:

1. A spout adapted for mounting on a liquid container outlet and comprising:

a body adapted for mounting on said container outlet;

a pouring tube extending from and fluidically connected with said body, said pouring tube presenting a pouring opening;

a stop operatively coupled with said pouring tube and shiftable between a first pouring position permitting liquid flow therepast and out said pouring opening, and a second position engaging the pouring tube in order to inhibit flow out said pouring opening;

a stop operator including an elongated, movable tubular rod coupled with said stop, and an engagement member coupled with said tubular rod and extending from said body for selective rod movement in order to thereby move said stop between said first and second positions thereof, said tubular rod having a hole which is located within said body when said stop is in said first position thereof, said tubular rod being oriented for the entry and passage of air therethrough and out said hole into the liquid container when said stop is in the first position.

2. A spout as set forth in claim 1, said stop being annular and mounted in surrounding relationship to said tubular rod.

3. A spout as set forth in claim 1, wherein said spout includes a pipe integrally formed with the body and a flexible extension fitted to the pipe.

4. A spout as set forth in claim 1, wherein said tube includes one end and another end, said stop being positioned at the one end, said at least one hole being positioned proximate the other end.

5. A spout as set forth in claim 1, including a spring positioned between said engagement member and said body for biasing said stop to said second flow inhibiting position.

6. A spout as set forth in claim 1, wherein said spout includes a sidewall having a port for receiving therethrough a vent tube fluidically coupled to said tubular rod.

7. A spout as set forth in claim 1, including in combination therewith a container for carrying liquid therein mounting said spout thereon.

8. A spout as set forth in claim 1, said body including a wall having an access therein, said tubular rod being oriented for passage through said access and for movement of said hole therethrough.

9. A spout as set forth in claim 2, wherein said pouring spout includes an annular seat extending radially inwardly for sealing engagement with said stop.

10. A spout as set forth in claim 4, wherein said engagement member comprises a button located at the other end of the tubular rod.

11. A spout as set forth in claim 5, wherein said spring is a coil spring positioned in surrounding relationship to said rod.

12. A spout as set forth in claim 11, wherein said body includes a wall presenting an access therethrough, said access being positioned opposite to said pouring spout for shiftably receiving said tubular rod therethrough, said spout further including a sealing ring carried by said tubular rod and located externally of said body, said spring lying in engagement with said sealing ring for biasing said sealing ring toward said access.

13. A spout as set forth in claim 12 wherein said at least one hole is located in said rod adjacent said access, whereby said hole is located inside said body when said stop is in said first flow permitting position and is located outside said body when said stop is in said second flow inhibiting position.

14. A spout as set forth in claim 12, including in combination therewith a container for carrying liquid therein mounting said spout thereon.

15. A spout as set forth in claim 8, including a sealing member mounted on said tubular rod intermediate said hole and said engagement member for sealing against said wall around said access to inhibit the passage of air past said rod when said stop is in said second position.

16. A method of pouring liquid from a dispenser to a receiving tank comprising the steps of:

providing a dispenser including a container and a spout mounted to the container, said container including a quantity of liquid therein, said spout including a body fluidically coupled to the liquid within the container, a pouring tube extending from and fluidically connected to the body, a stop operably coupled with the pouring tube and shiftable between a first pouring position permitting the liquid to flow therepast and out of the pouring opening and a second position engaging the pouring tube in order to inhibit the flow of liquid out of said pouring opening, a stop operator including an elongated moveable tubular rod coupled with said stop and an engagement member coupled with and extending exteriorly of said body for selective rod movement in order to thereby move said stop between said first and second positions, the tubular rod having a hole which is located within the body when the stop is in the first position, the tubular rod being oriented for entry and passage of air therethrough and out of the hole into the liquid container when the stop is in the first position;

actuating said engagement member to shift said tubular rod relative to the body and move said stop from said first position to said second position;

dispensing liquid past said stop and into the receiving tank while permitting air to enter into the dispenser past said stop through said tubular rod and out of the tubular rod through the hole;

decreasing the flow of liquid from the spout as the level of the liquid in the receiving tank rises to block the entry of air into the tubular rod.

17. A method of pouring liquid as set forth in claim 16, including shifting the tubular rod to move the stop to the second position to block the flow of liquid past the pouring opening.

18. A method as set forth in claim 16, wherein said pouring tube includes a sidewall having a port therethrouoh and a vent tube fluidically coupled to said tubular rod and into said port, whereby said dispensing step further includes passing air through said port and said vent tube and into said tubular rod.

19. A method as set forth in claim 16, wherein said hole is positioned out of fluid communication with the liquid within the container when the stop is in the second position.

20. A method as set forth in claim 17, wherein the rod is biased to move the stop to the second position when the engagement member is released.

* * * * *